US007980292B2

(12) United States Patent
Poloni et al.

(10) Patent No.: US 7,980,292 B2
(45) Date of Patent: Jul. 19, 2011

(54) CRYSTALLISER HOLDING DEVICE

(75) Inventors: Alfredo Poloni, Fogliano Redipuglia (IT); Andrea De Luca, Remanzacco (IT); Marco Ansoldi, Udine (IT)

(73) Assignee: Danieli & C. Officine Meccaniche, S.p.A. (IT)

( * ) Notice: Subject to any disclaimer, the term of this patent is extended or adjusted under 35 U.S.C. 154(b) by 378 days.

(21) Appl. No.: 12/224,160

(22) PCT Filed: Feb. 23, 2007

(86) PCT No.: PCT/EP2007/051758
§ 371 (c)(1), (2), (4) Date: Aug. 19, 2008

(87) PCT Pub. No.: WO2007/096420
PCT Pub. Date: Aug. 30, 2007

(65) Prior Publication Data

US 2009/0014147 A1 Jan. 15, 2009

(30) Foreign Application Priority Data

Feb. 24, 2006 (IT) ..... MI2006A0335

(51) Int. Cl.
*B22D 11/055* (2006.01)
*B22D 11/124* (2006.01)

(52) U.S. Cl. ..... 164/443; 164/348

(58) Field of Classification Search ..... 164/348, 164/443, 485
See application file for complete search history.

(56) References Cited

U.S. PATENT DOCUMENTS

| | | | | |
|---|---|---|---|---|
| 6,298,905 | B1 * | 10/2001 | Kaell et al. | 164/416 |
| 6,318,449 | B1 * | 11/2001 | Jolivet et al. | 164/444 |
| 6,367,539 | B1 * | 4/2002 | Poloni et al. | 164/443 |
| 2001/0042609 | A1 * | 11/2001 | Poloni et al. | 164/485 |

FOREIGN PATENT DOCUMENTS

| | | |
|---|---|---|
| DE | 867735 | 2/1953 |
| WO | WO 98/53935 | 12/1998 |

* cited by examiner

*Primary Examiner* — Kevin P Kerns
(74) *Attorney, Agent, or Firm* — Stetina Brunda Garred & Brucker

(57) ABSTRACT

Provided is a crystalliser holding device for billets, blooms and slabs production plants that has a high constructive simplicity, a significantly reduced overall weight and that reduces substantially to zero the need for maintenance. The crystalliser holding device of the invention, in addition to efficaciously guaranteeing the transfer toward the exterior of the heat of the liquid steel introduced into the tubular crystalliser contained therein, also provides a separate circuit for cooling the continuous ingot exiting the crystalliser and the rollers at the foot. It also permits an easy and rapid replacement in the oscillating table in which it is housed.

14 Claims, 6 Drawing Sheets

Section A-A

CRYSTALLISER HOLDING DEVICE

TECHNICAL FIELD

The present invention refers to a crystalliser holding device, specifically a device suited to housing a crystalliser used in plants for the production of steel billets, blooms and slabs, suited to being fastened in an oscillating table.

STATE OF THE ART

The state of the art includes numerous crystalliser holding devices, also known as cartridges, described in different patent documents.

Of these documents, patent GB2156252 describes a continuous casting device comprising a crystalliser inserted inside a crystalliser holding cooling device. This device in turn comprises an upper chamber for the distribution of the pressurised cooling fluid inside a space, or gap, between a crystalliser guiding wall and the crystalliser itself, and a lower cooling fluid return chamber. There are provided relative ducts for the entry of the fluid into the upper chamber and for the exit of the fluid from the lower chamber.

A first disadvantage of this casting device is that of providing an introduction of the pressurised fluid into the aforesaid gap, which inevitably entails a deformation of the crystalliser walls under hydraulic thrust.

A further disadvantage is represented by the fact that in the upper distribution chamber the pressurised cooling fluid generates a force that acts also on the upper closing flange, that therefore must be made with a great thickness in order to prevent the deformation thereof under the considerable hydraulic thrust and, furthermore, must be fastened with a considerable number of screws to the support structure.

Furthermore, such a device makes the operation of replacing the crystalliser inconvenient in the case, for example, that the format of the product to be cast has to be changed.

A second example of known crystalliser holding device is that one described in the document U.S. Pat. No. 5,715,888. In this case, the crystalliser provides a longitudinal cooling gap, fed with a cooling fluid by a feeding chamber that is an integral part of the block containing the crystalliser and elements thereof are held together by mechanical fixing means. Such block is entirely extractable from the mobile structure of the oscillating table.

Disadvantageously, this configuration of the cooling fluid feeding circuit is also such as to deform the crystalliser walls and to exert a significant hydraulic thrust on the upper closing flange that must therefore be fastened to the support structure with a high number of screws, which complicates both achievement of the crystalliser holding device and the crystalliser changing operations, and entails high production costs.

The need is therefore felt to make an innovative crystalliser that makes it possible to overcome the abovementioned drawbacks.

SUMMARY OF THE INVENTION

The primary purpose of the present invention is to achieve a crystalliser holding device or cartridge, containing a crystalliser for steel billets, blooms and slabs production plants, that has a high constructive simplicity, a significantly reduced overall weight and that reduces substantially to zero the need for maintenance.

A second purpose is that of achieving a crystalliser holding device provided with a complete cooling system that, in addition to efficaciously guaranteeing the transfer toward the exterior of the heat of the liquid steel introduced into the crystalliser, i.e. the so-called primary cooling, also provides a separate circuit for the cooling of the continuous ingot exiting the crystalliser and of the rollers at the foot.

A further purpose of the crystalliser holding device of the invention is, lastly, that of making easy and rapid the replacement of the crystalliser in the oscillating table inside which it is housed.

The present invention, therefore, aims to overcome the drawbacks described above by achieving a crystalliser holding device for casting steel products such as billets, blooms and slabs that, according to one embodiment includes:

- a tubular crystalliser defining a longitudinal casting direction provided with a plurality of longitudinal channels in its thickness for the passage of a first cooling fluid,
- a substantially ring-shaped casing arranged at a first end of said tubular crystalliser comprising a first chamber for feeding the first cooling fluid into said plurality of channels, characterised by the fact that said crystalliser holding device provides at least one first duct for the re-ascent of the first cooling fluid, said first duct communicating with a second chamber for recycling the first fluid provided in said casing.

The crystalliser housed in the cartridge of the invention, which can be straight or curved, is provided with a plurality of longitudinal cooling holes or channels made in its thickness, which permits minor deformation of the walls thereof following the pressure of the cooling fluid that flows inside said holes, and therefore a greater overall stiffness and an efficient heat exchange between steel and cooling fluid, the holes or channels being very close to the inner wall of the crystalliser. Therefore, with respect to the solutions of the known art, the cooling fluid pressure advantageously does not negatively influence the geometry of the crystalliser and furthermore does not generate undesired forces on the upper fixing flange.

The crystalliser holding device of the invention also makes it possible to obtain the following advantages:

- a low overall weight, thanks to its innovative constructive conformation, and therefore low inertia, not necessitating high actuation forces of the entire mobile structure of the oscillating table and allowing the use of small dimension table oscillation controls;
- the possibility of an extremely rapid crystalliser replacement, when necessary due to wear or format changes, thanks to the hydraulic brackets clamping system placed at the summit of the table.

Advantageously, the feeding manifold of said fluid, being part of the crystalliser holding device, is fixed to the table by means of said hydraulic brackets: the presence of fixing screws and bolts is therefore reduced to a minimum, if not eliminated, and the replacement time is reduced to a minimum.

A further advantage is represented by the fact that the crystalliser holding device, object of the present invention, allows housing in an oscillating table with a particular configuration of the guiding elements thereof, for example pairs of elastic bars having a round or flattened shape, that permit oscillation exclusively in the casting direction and exclude any roll movements around axes perpendicular to the casting axis.

The dependent claims describe preferred embodiments of the invention.

BRIEF DESCRIPTION OF THE FIGURES

Further characteristics and advantages of the invention will be further evident in view of the detailed description of a preferred, though not exclusive, embodiment of a crystalliser holding device, such as illustrated by way of non limiting example, with the aid of the appended drawings wherein.

DETAILED DESCRIPTION OF PREFERRED EMBODIMENTS OF THE INVENTION

Figure 3:
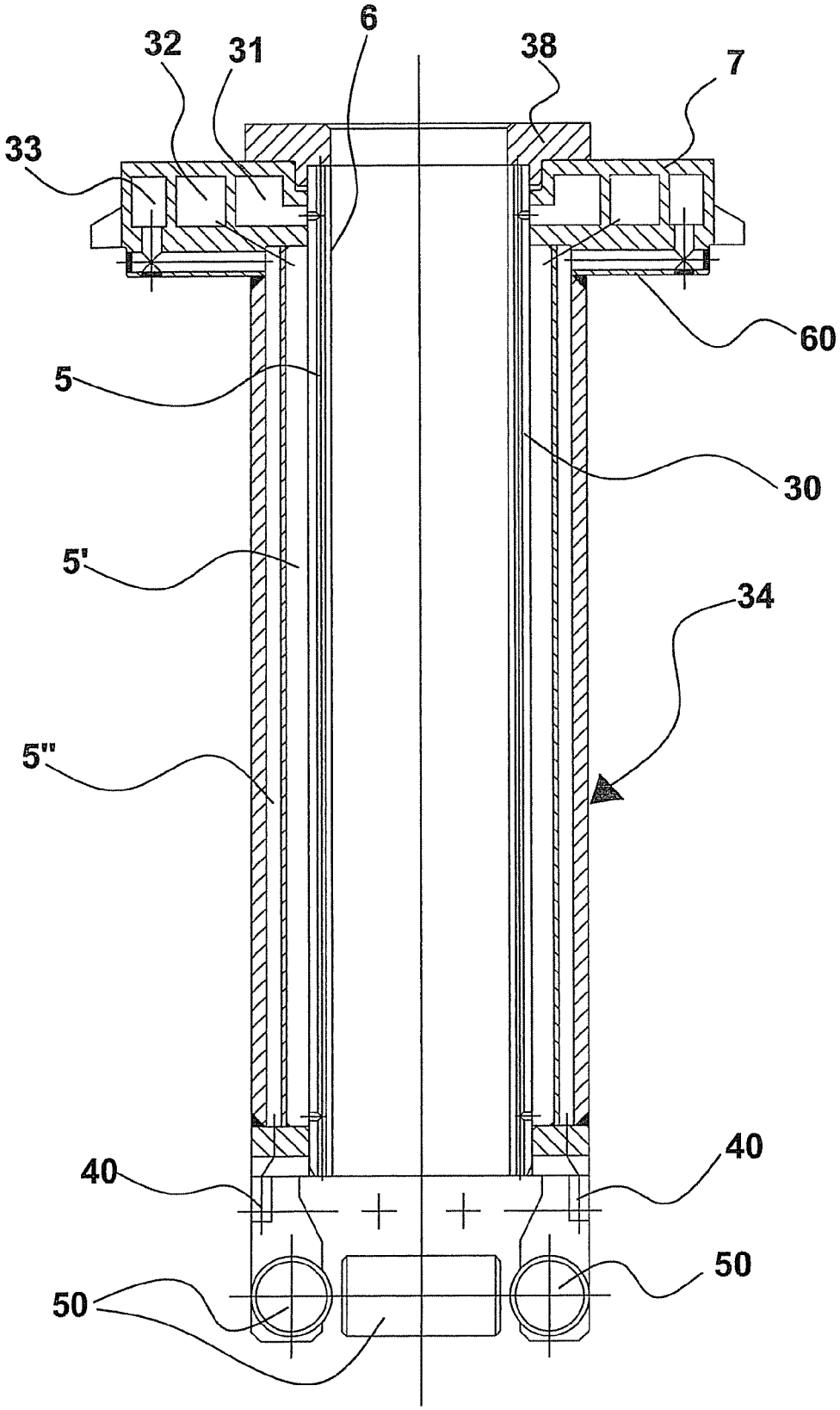
FIG. 3 represents a vertical section of a first embodiment of the crystalliser holding device according to the invention.

With reference to FIG. 3, a first embodiment of the crystalliser holding device or cartridge of the invention is represented. Such crystalliser holding device 34 houses a tubular crystalliser 30 and is provided with a manifold 7 for feeding and distributing at least one crystalliser cooling fluid.

Crystalliser 30 and manifold 7 are solidarily joined by an upper closing flange 38. The crystalliser holding device 34 is inserted into an oscillating table support structure 20, suited to being oscillated by an oscillation control comprising for example a pair of hydraulic or mechanical actuation means 3, such as cylinders, provided on an external support structure 10 fixed to the ground.

The crystalliser holding device 34 comprises a ring-shaped manifold 7 for feeding cooling fluids, obtained by melting or by means of an electrowelded structure, which surrounds the head of the tubular crystalliser 30.

Advantageously the crystalliser holding device 34 is fixed to the oscillating table thanks to the surface 60, which acts as a rest to the support structure 20, and by means of hydraulic brackets 15, thus completely eliminating the presence of fixing screws and bolts.

The crystalliser 30, which is preferably monolithic, is provided with longitudinal cooling holes 5 made in the thickness thereof: this gives it greater stiffness and makes it possible to avoid walls deformation following the pressure of the cooling fluid.

The longitudinal holes 5 of the so-called primary cooling, being close to the inner walls 6 of the crystalliser, permit an excellent heat exchange and, therefore, the transfer of the liquid metal heat, inside the crystalliser, towards the outside, thus advantageously obtaining a lower rhomboidity of the cast product and a better external superficial quality thereof; furthermore, this type of crystalliser construction is able to maintain the design taper thereof over time.

The primary cooling fluid, generally water, is introduced into the holes 5 from the top towards the bottom through a first feeding chamber 31 of the ring-shaped manifold 7, fed by hoses not shown. The feeding from the top towards the bottom allows a better heat exchange in the top part of the crystalliser.

The inner wall of the crystalliser holding device 34 and the external one of the crystalliser 30 advantageously define a duct 5' for the re-ascent of the primary cooling fluid. The longitudinal holes or channels 5 are in fact communicating with the duct 5' in correspondence with the foot of the crystalliser 30.

Advantageously, the ring-shaped manifold 7 also comprises the return circuit chamber 32 of the primary cooling fluid and a second feeding chamber 33 of the secondary cooling fluid, preferably untreated water, that goes to feed the sprays 40, arranged in correspondence with the rollers 50 at the foot of the crystalliser 30, crossing a further duct or several ducts 5", made in the thickness of the crystalliser holding device 34.

By means of the sprays 40 the continuous ingot is cooled directly upon exiting the crystalliser and, furthermore, the same rollers 50 at the foot are cooled externally. Advantageously, the presence of the three-chambered manifold 7 and the relative holes or channels or ducts 5, 5', 5", made in the thickness of the crystalliser walls and of the crystalliser holding device, allow a greater compactness of the entire ingot mould and a reduction in weight of the support structure 20, and therefore a lower inertia of the mobile part of the table that must be oscillated by the table. Preferably the longitudinal holes 5 are arranged in a parallel way with respect to one another and to the casting direction or axis X; and the chambers 31, 32, 33 are arranged inside the ring-shaped manifold 7 in a concentric way with respect to said casting direction.

On a plane perpendicular to casting direction X, the crystalliser 30 may have, for example, a circular or square or rectangular section or other form.

Figure 4A:
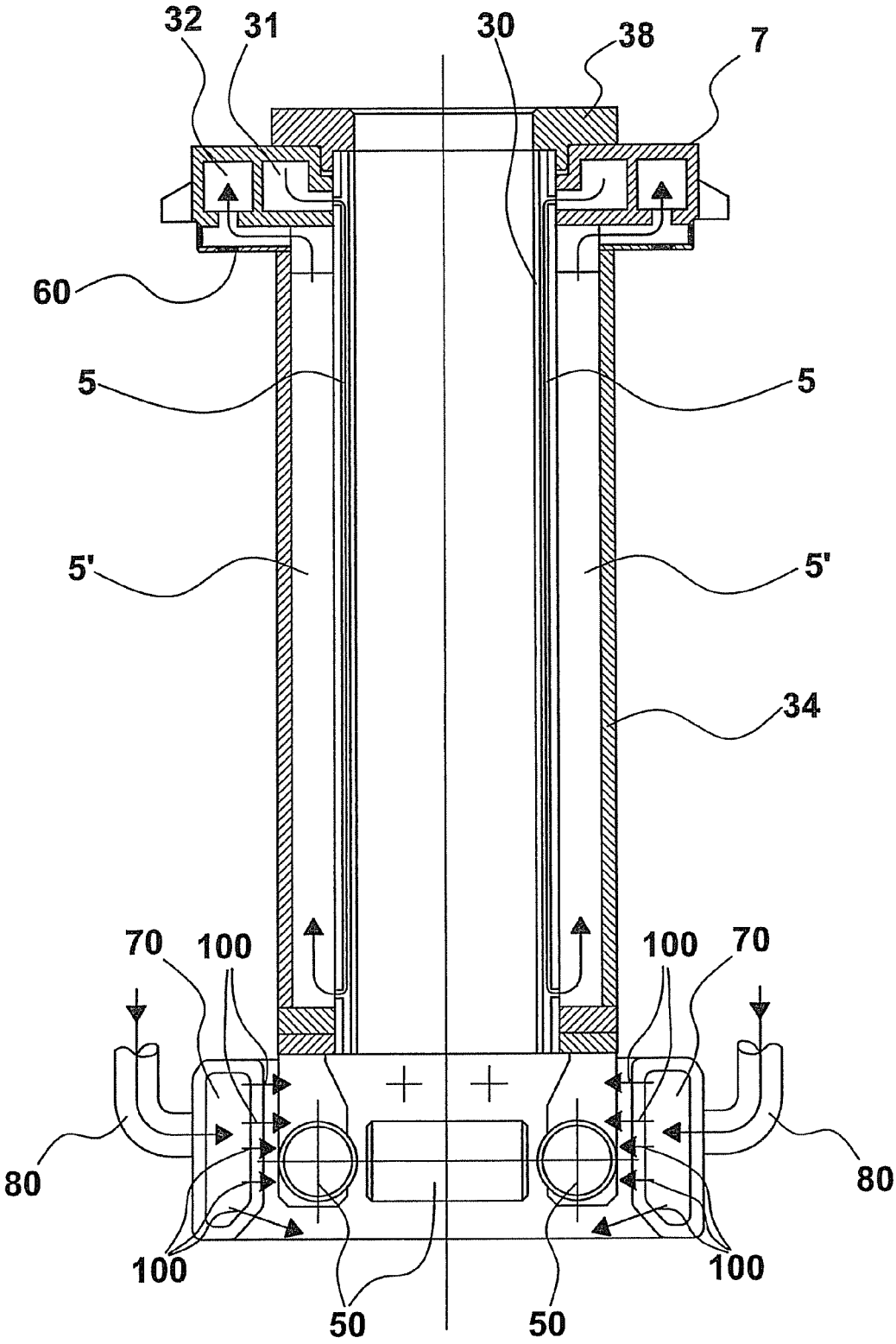
FIG. 4*a* represents a vertical section of a second embodiment of the crystalliser holding device according to the invention.

A second advantageous embodiment of the crystalliser holding device of the invention is shown in FIG. 4*a*. In this case, the cooling fluid feeding manifold 7, preferably but not necessarily ring-shaped, comprises only the primary cooling fluid feeding chamber 31 and the return circuit chamber 32 of said fluid. In addition to the longitudinal holes or channels 5 made in the thickness of the crystalliser 30, only one or more ducts 5' are provided in the cartridge 34 for the re-ascent of the primary cooling fluid. Also in this case, in fact, the longitudinal holes 5 are communicating with the duct 5' in correspondence with the foot of the crystalliser 30.

Advantageously the secondary cooling, i.e. the cooling, with untreated water, of the continuous ingot upon exiting the crystalliser and of the rollers 50 at the foot, is made by means of one or more external water feeding manifolds, arranged in correspondence with the lower end of the crystalliser.

A first variant of this second embodiment, illustrated in FIG. 4*a*, provides an external manifold 70 fixed to the external support structure 10, fixed to the ground, of an oscillating table in which the crystalliser holding device is housed. In this first variant, the external manifold is constituted by a ring-shaped chamber 70 fed with a pressurised cooling fluid, generally untreated water, by tubes 80. In the internal part thereof, said ring-shaped chamber 70 is provided with a plurality of holes 100, suited to generating jets of said fluid towards the rollers 50 at the foot and the continuous ingot.

Figure 4B:
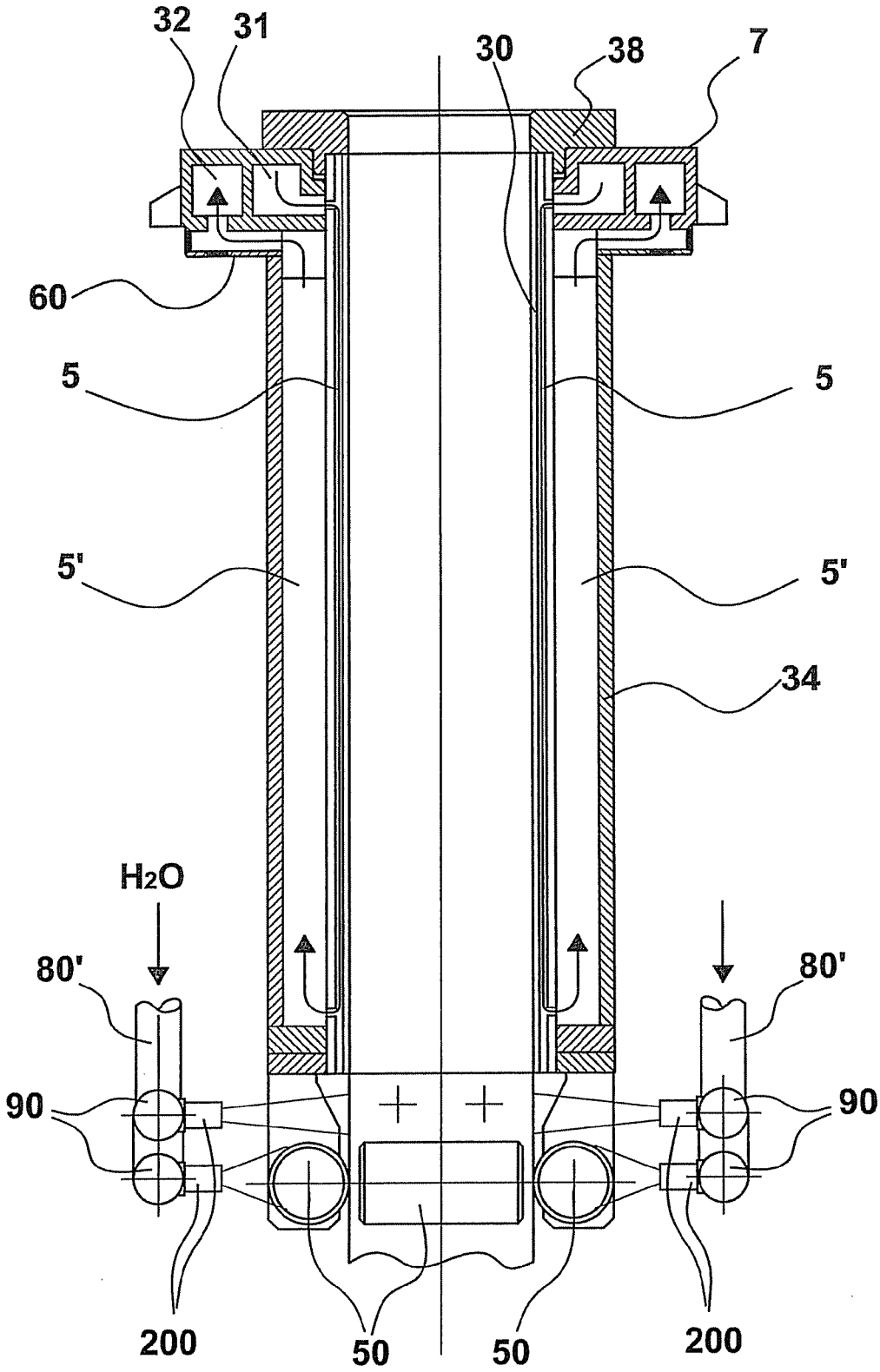
FIG. 4*b* represents a variant of a part of said second embodiment of the crystalliser holding device.

A second variant of this second embodiment, illustrated in FIG. 4*b*, on the other hand, provides tubes 80' that feed ring-shaped manifolds 90 that in turn feed spray nozzles 200, arranged in correspondence with the rollers 50 at the foot of the crystalliser 30.

Advantageously, this second embodiment of the crystalliser holding device in its two variants makes it possible to obtain a greater compactness of the manifold 7, a reduction of the overall dimensions and a greater constructive simplicity of the crystalliser holding device, as fewer seals are needed, and a lower overall weight of the cartridge-crystalliser complex.

This secondary cooling system, in both the variant with spray nozzles and in the perforated chamber variant, is fixed to the fixed support structure of the oscillating table and therefore it does not oscillate with the rest of the ingot mould, thus reducing the inertia of the mobile part made to oscillate by the table.

A further advantage is represented by the fact that such external secondary cooling system is not replaced together with the crystalliser and can be used for all cast sections.

Figure 1:
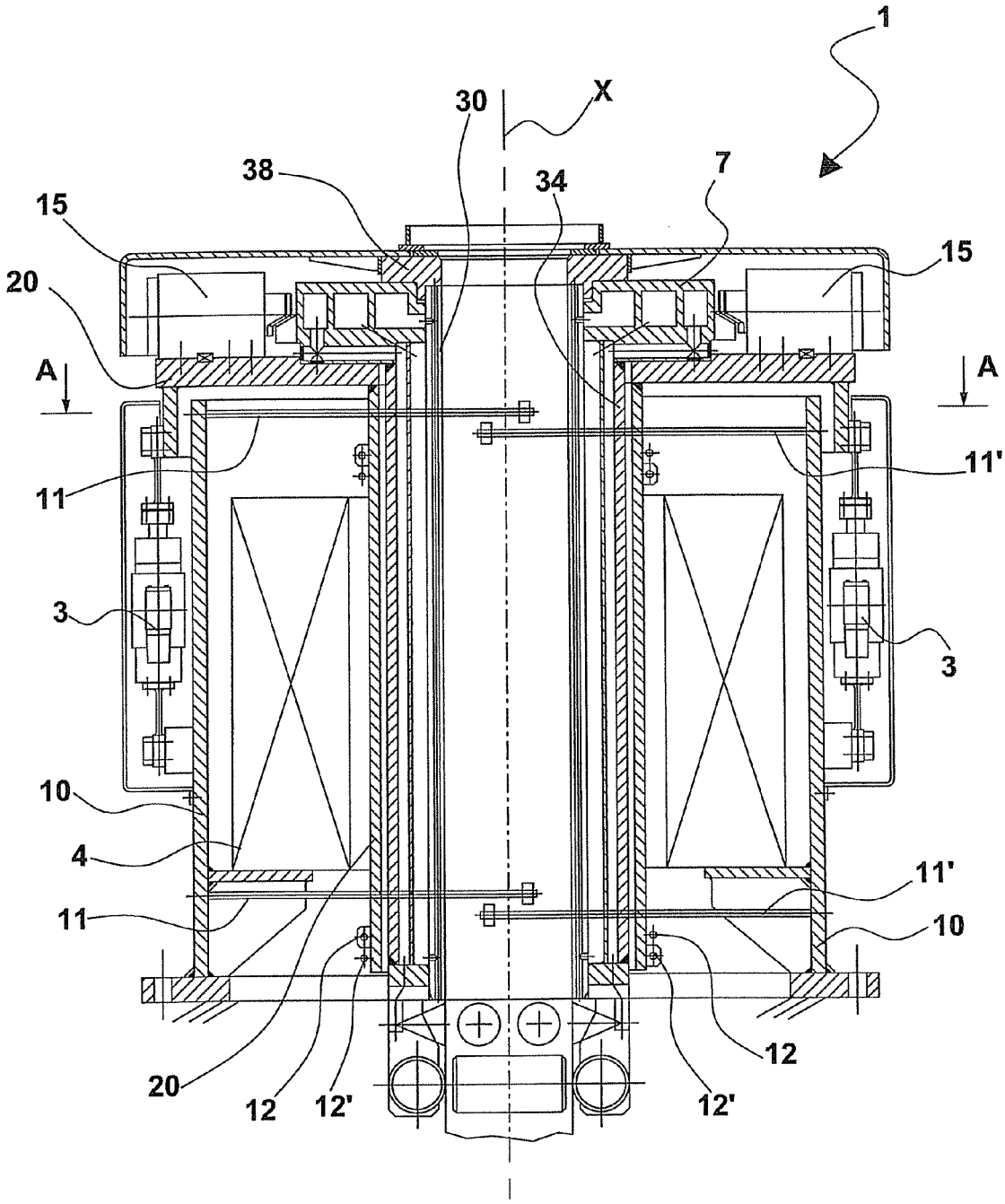
FIG. 1 represents a vertical section of a first oscillating table comprising a crystalliser holding device according to the invention.
Figure 2:
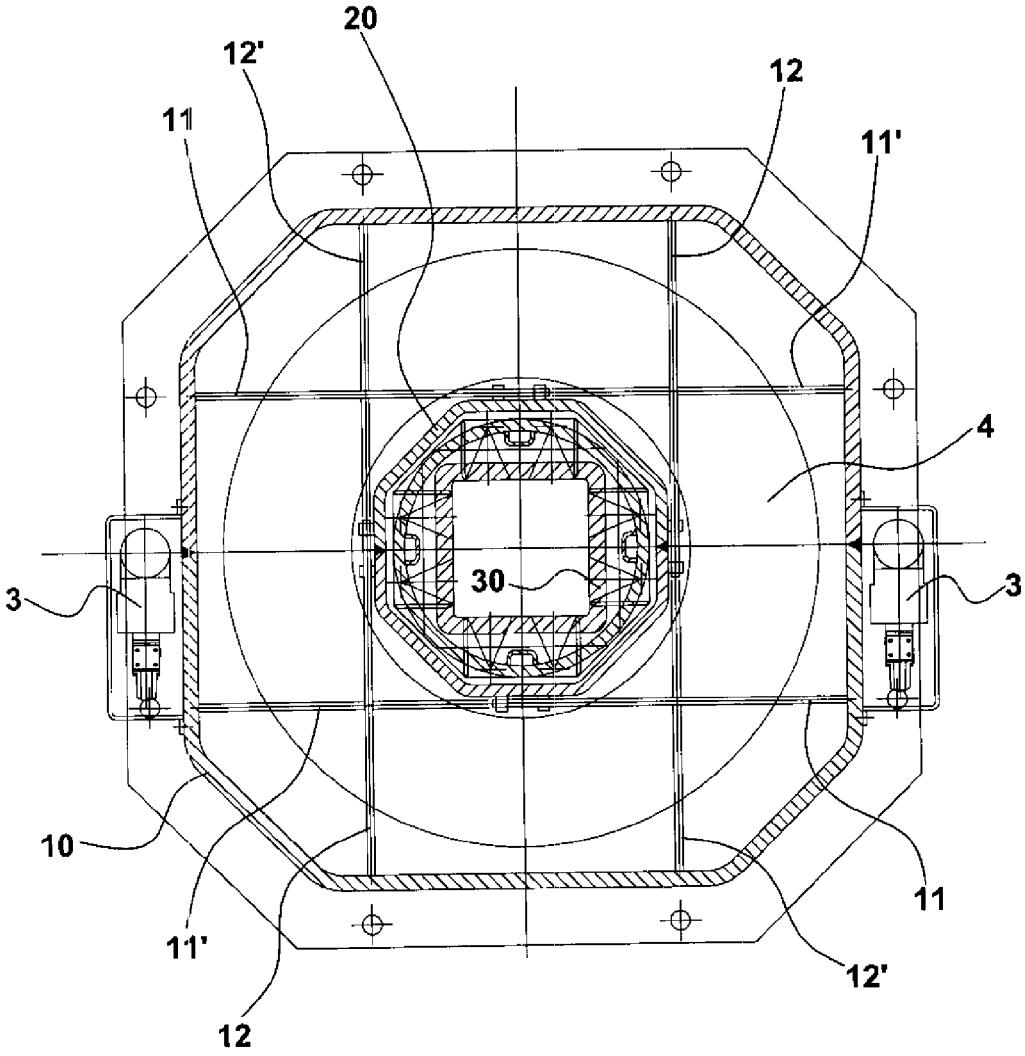
FIG. 2 represents a section along the A-A plane of the plane view of the oscillating table of FIG. 1.

A further advantage of the crystalliser holding device of the invention derives from the fact of having a compact configuration such as to be housed with a simple operation in a suitable oscillating table, globally indicated with reference 1, illustrated in FIGS. 1 and 2. In fact, it is possible to extract by means of an appliance the single block of the crystalliser holding device comprising the ring-shaped manifold 7 and the crystalliser 30, provided with both primary and secondary or just primary cooling ducts, simply by acting on the hydraulic brackets 15.

These hydraulic or mechanical oscillation actuation means 3 are connected to the ground with interlocking leaf-springs and are connected at the other extremity thereof to the structure 20, as a mobile element, again with an interlocking leaf-spring. As in such an oscillation control there is a complete absence of bearings, pins, joints or other mechanical organs, one eliminates the clearances of such components, which are notoriously subject to wear, entailing frequent maintenance operations.

In order to avoid deviations of the crystalliser 30 from the desired trajectory, preferably that along the casting direction or axis X defined by the same crystalliser, there are provided elastic guiding elements 11, 11', 12, 12' of the support structure 20 housing in the central cavity thereof the crystalliser holding device 34, closely fastened thereto by means of hydraulic brackets 15 or other mechanical means.

Such guiding elements 11, 11', 12, 12', for example in the form of interlocking round or flattened elastic bars, are arranged as illustrated, for example, in FIGS. 1 and 2. In this preferred embodiment, such elastic guiding elements advantageously comprise four pairs of first elastic bars 11, 11' and four pairs of second elastic bars 12, 12'. The number of the pairs of first and second bars may also be different but is in any case an even number.

The four pairs of the first elastic bars 11, 11' are arranged in pairs respectively on two first vertical planes parallel to one another and to the casting axis X and equidistant from said axis. Similarly, the four pairs of the second elastic bars 12, 12' are arranged in pairs respectively on two second vertical planes parallel to one another and to the casting axis X and equidistant from said axis; said second planes being substantially perpendicular to said first planes.

The bars 11, 11', 12, 12', such as for example round bars or bars of other substantially flattened shape sections, such as, for example, rectangular, are fixed at a first extremity thereof to the second support structure 20 of the crystalliser holding device 34, i.e. to the mobile part of the oscillating table, and at a second extremity thereof they are fixed to the outer support structure 10. The systems for fixing the bars to the support structure 20 are constituted, for example, by brackets welded to said structure that present passing holes in which the bars are inserted; the ends of such bars are threaded and the locking thereof on the brackets takes place by means of nuts. The fixing of the bars to the outer support structure 10 can be performed with similar systems, i.e. by means of introduction of the threaded end of the bars into the thickness of the structure and locking thereof with nuts.

On each of these first and second vertical planes, the distance between the upper pair of bars, arranged in the proximity of the crystalliser head, and the lower pair, arranged in the proximity of the crystalliser feet, is advantageously the same. The first elastic bars 11, 11' are parallel to one another, as are the second elastic bars 12, 12'.

The elastic bars are arranged so as to be stiff to bending in the transverse directions with respect to the casting or oscillating direction X and flexible in direction X only.

One embodiment provides the use of leaf-springs or similar springs as elastic guiding elements of the crystalliser 30.

Advantageously, the fact that on each of said first and second vertical planes, each of the elastic bars of each pair presents the first end fixed to the mobile part of the table and the second end fixed to the fixed part in the opposite way with respect to the corresponding ends of the immediately adjacent bar of the same pair, together with the fact that the arrangement of the pairs of corresponding bars respectively on the first and second planes is asymmetrical with respect to the casting direction or axis X (as shown for example by observing the bars 12, 12' in FIG. 1 or in FIG. 2), makes the oscillation of the crystalliser 30 of the invention only possible along the direction of casting axis X.

In fact, such configuration of the pairs of elastic bars 11, 11', 12, 12' makes it possible to contrast each torsion moment that could occur parallel to the casting direction X. According to the sense of this torsion moment, half of the bars will be subject to traction, acting as tie rods, whereas the other half will be subject to compression, acting as struts.

The use of simplified elastic guiding elements and the particular configuration thereof thus allow a very high crystalliser guiding precision and a considerable reduction in the oscillation marks on the cast product.

Figure 1A:
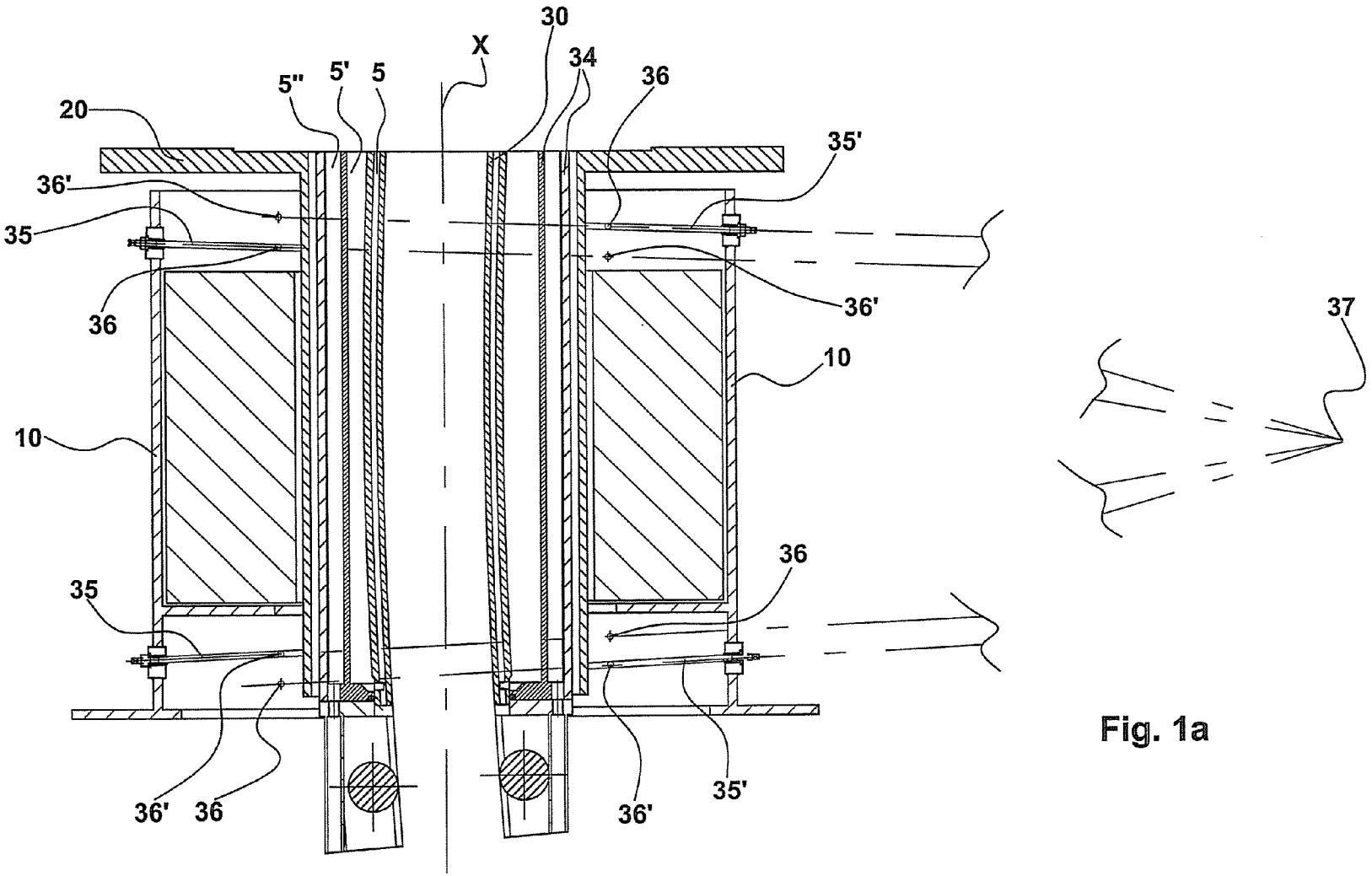
FIG. 1*a* represents a vertical section of a second oscillating table comprising a variant of the crystalliser holding device according to the invention.

The crystalliser holding device of the invention also advantageously provides the housing of curved crystallisers. In these cases, such crystalliser holding device can be housed with a simple operation inside the second support structure 20 of an appropriate oscillating table illustrated in FIG. 1*a*.

In this case, the oscillating table advantageously provides on the two first vertical planes two pairs of first elastic guiding elements 35, 35', for example in the form of interlocking rounded or flattened elastic bars, each pair having a predetermined inclination, equal in absolute value but opposite in sign to the other pair, with respect to a horizontal plane perpendicular to casting direction X. On each first vertical plane, the two pairs of first elastic bars 35, 35' respectively have an ideal intersection point 37 that defines a common centre of rotation. The two centres of rotation are arranged on an axis of rotation lying on said horizontal plane and perpendicular to casting direction or axis X in order to allow the oscillating movement of the table following a circumference arc corresponding to a predetermined radius of curvature.

In general, the pairs of the first elastic bars 35, 35' on each first vertical plane are not parallel to one another, they may present different inclinations to one another and their ideal intersection point defines a common ideal centre of rotation.

Similarly to the first embodiment, there are provided four pairs of second elastic bars 36, 36', arranged in pairs respectively on two second vertical planes parallel to one another and to the casting axis X, and equidistant from said axis; said second planes being substantially perpendicular to said first planes. The second elastic bars 36, 36', unlike the first bars 35, 35', are arranged horizontally and are all parallel to one another.

Also in this embodiment of the table, the fact that on each of said first and second vertical planes each of the elastic bars of each pair presents the first end fixed to the mobile part of the table and the second end fixed to the fixed part in the opposite way with respect to the corresponding ends of the immediately adjacent bar of the same pair, together with the fact that the arrangement of the corresponding pairs of bars respectively on the first and second planes is asymmetrical with respect to the casting direction or axis X, makes the oscillation of the crystalliser 30 only possible along the direction of the casting axis X, following a circumference arc corresponding to a predetermined radius of curvature, substantially equal to the radius of curvature of the curved crystalliser or of a different value.

In both embodiments of the oscillating table described above, the use of significantly simplified elastic guiding elements and the particular configuration thereof thus allow a very high crystalliser guiding precision and a considerable reduction in the oscillation marks on the cast product.

The oscillating table comprising the crystalliser holding device of the invention, thanks to the improvements described above, also allows a greater compactness and constructive simplicity and an operation at oscillation frequencies of over 6 Hz, higher than the normal frequencies equal to 4 Hz. In the case of the production of cast products, for example those made of special steels and quality steels, there is provided the use of an electromagnetic stirrer 4, arranged between first 10 and second 20 support structure and advantageously protected from heat load.

Lastly, given the compactness and the lower weight of the crystalliser holding device, it is not necessary to provide further elastic means, for example compression or air or leaf-springs, with the function of lightening the crystalliser holding device and the mobile structure of the table through a better weight distribution.

The particular embodiments described herein do not restrict the scope of this application, which covers all the invention variants defined in the claims.

The invention claimed is:

1. Crystalliser holding device for casting steel products from liquid steel, comprising:

a tubular crystalliser defining a longitudinal casting direction X provided with a plurality of longitudinal channels for a passage of a first cooling fluid, a substantially ring-shaped casing arranged at a first end of said tubular crystalliser comprising a first chamber for feeding the first cooling fluid into said plurality of longitudinal channels, wherein the tubular crystalliser is monolithic and the longitudinal channels are made in its thickness, whereby said longitudinal channels are close to the inner walls of said crystalliser and provide a primary cooling of the liquid steel, wherein said first cooling fluid is introduced into said longitudinal channels from the top towards the bottom through said first chamber of the ring-shaped casing, wherein the inner wall of said crystalliser holding device and the external wall of the crystalliser provides at least one first re-ascent duct for the first cooling fluid, said first duct communicating with a second chamber for recycling the first fluid provided in said casing, wherein said longitudinal channels are in communication with said first duct in correspondence with a second end in correspondence of a foot of the tubular crystalliser, wherein there is provided at least one second duct communicating with a third chamber for feeding a second fluid provided in said casing.

2. Crystalliser holding device according to claim 1, wherein said plurality of longitudinal channels is communicating with said at least one first duct in correspondence with a second end of the tubular crystalliser.

3. Crystalliser holding device according to claim 2, wherein there are provided hydraulic brackets for fixing said device to a mobile part of an oscillating table.

4. Crystalliser holding device according to claim 3, wherein the tubular crystalliser has a section, on a plane perpendicular to the casting direction X, of a circular or square or rectangular shape.

5. Crystalliser holding device according to claim 1, wherein said second duct is suited to feeding spray means with the second fluid, for a cooling arranged at the second end of the tubular crystalliser.

6. Crystalliser holding device according to claim 5, wherein the plurality of longitudinal channels and said at least one first and second ducts are arranged parallel to one another and to the casting direction X.

7. Crystalliser holding device according to claim 6, wherein said first, second and third chambers are arranged inside the casing in a concentric way with respect to the casting direction X.

8. Crystalliser holding device for casting steel products from liquid steel, comprising:

a tubular crystalliser defining a longitudinal casting direction X provided with a plurality of longitudinal channels for a passage of a first cooling fluid, a substantially ring-shaped casing arranged at a first end of said tubular crystalliser comprising a first chamber for feeding the first cooling fluid into said plurality of longitudinal channels, wherein the tubular crystalliser is monolithic and the longitudinal channels are made in its thickness, whereby said longitudinal channels are close to the inner walls of said crystalliser and provide a primary cooling of the liquid steel, wherein said first cooling fluid is introduced into said longitudinal channels from the top towards the bottom through said first chamber of the ring-shaped casing, wherein the inner wall of said crystalliser holding device and the external wall of the crystalliser provides at least one first re-ascent duct for the first cooling fluid, said first duct communicating with a second chamber for recycling the first fluid provided in said casing, wherein said longitudinal channels are in communication with said first duct in correspondence with a second end in correspondence of a foot of the tubular crystalliser, wherein in correspondence with the second end of the tubular crystalliser there is provided at least one manifold, external to the crystalliser and fixed to a fixed frame housing the crystalliser holding device, for the passage of a pressurised second cooling fluid, said external manifold being suited to being fed with the second cooling fluid by tubes.

9. Crystalliser holding device according to claim 8, wherein said external manifold comprises a ring-shaped chamber provided with a plurality of holes suited to generating jets of said second fluid for a cooling arranged at the second end of the tubular crystalliser.

10. Crystalliser holding device according to claim 9, wherein there are provided one or more manifolds suited to feeding with the second fluid spray means, for a cooling arranged at the second end of the tubular crystalliser.

11. Crystalliser holding device according to claims 10, wherein the plurality of longitudinal channels and said at least one first duct are arranged parallel to one another and to the casting direction X.

12. Crystalliser holding device according to claim 11, wherein said first and second chambers are arranged inside the casing in a concentric way with respect to the casting direction X.

13. Crystalliser holding device according to claims 8, wherein the plurality of longitudinal channels and said at least one first duct are arranged parallel to one another and to the casting direction X.

14. Crystalliser holding device according to claim 13, wherein said first and second chambers are arranged inside the casing in a concentric way with respect to the casting direction X.

* * * * *